United States Patent [19]

Dubpernell et al.

[11] Patent Number: 4,602,983

[45] Date of Patent: Jul. 29, 1986

[54] METHOD OF IMPROVING THE DISTRIBUTION AND BRIGHTNESS OF CHROMIUM PLATE

[76] Inventors: George Dubpernell, 13366 Wales, Huntington Woods, Mich. 48070; Donald J. Kenney, 30605 Squires Trail, Apt. 22, Farmington Hills, Mich. 48018; Krisanapol Komolboon, 49/1 Changwatana Rd., Bankaen, Bangkok 10210, Thailand

[21] Appl. No.: 572,497

[22] Filed: Jan. 19, 1984

[51] Int. Cl.[4] ..... C25D 3/04

[52] U.S. Cl. ..... 204/51

[58] Field of Search ..... 204/51, 105 R

[56] References Cited

U.S. PATENT DOCUMENTS 4,093,522 6/1978 Dillenberg ..... 204/51

4,234,396 11/1980 Perakh et al. ..... 204/51

OTHER PUBLICATIONS

R. M. Krishnan et al., Metal Finishing, pp. 55-61, Oct. 1981.

*Primary Examiner*—G. L. Kaplan

*Attorney, Agent, or Firm*—Cullen, Sloman, Cantor, Grauer, Scott & Rutherford

[57] ABSTRACT

A process to improve the distribution and brightness of chromium plate by the addition to and maintenance in the bath of chlorine in various valence states, simultaneously, wherein equilibrium is maintained in the bath.

3 Claims, 3 Drawing Figures

CHROMIUM THICKNESS (INCH) x 10^-4
DISTANCE (INCH)
0
2
4
6
8
10
12
14
16
18
20
22
24
26
28
30
32
34
36
0.5
1.0
1.5
2.0
2.5
3.0
10
16
18

CHROMIUM THICKNESS (INCH) x 10^-4
DISTANCE (INCH)
0
2
4
6
8
10
12
14
16
18
20
22
24
26
28
30
32
34
36
0.5
1.0
1.5
2.0
2.5
3.0
10
12
14

METHOD OF IMPROVING THE DISTRIBUTION AND BRIGHTNESS OF CHROMIUM PLATE

BACKGROUND OF THE INVENTION

For more than fifty years the fundamental principles of chromium plating have been those established by Colin G. Fink in U.S. Pat. No. 1,581,188 issued Apr. 20, 1926. Fink taught that the totality of all acid radicals (catalyst anions) in chromic acid chromium plating solutions had to be determined and controlled at a specific amount relative to the concentration of chromic acid in the solution. Specifically, Fink taught that in the case of sulfate the totality of all radicals should approximate 2.5 grams per liter in a solution containing 250 grams per liter of chromic acid. That is, the ratio of the chromic acid to the radicals should be approximately 100:1.

Fink discusses both stable and unstable radicals at some length without giving specific directions for the use of any of the radicals except sulfate. Fink states that it is a simple matter to ascertain the amount of any radical which is equivalent to a given quantity of sulfate radical, but this is not correct and the industry has labored under a great handicap because of the lack of specific directions for the manner in which radicals other than sulfate must be handled.

Specifically, Fink refers to four radicals as stable: sulfate, fluoride, phosphate and borate. However, phosphate and borate have essentially no catalytic effect and are not used. Fluoride is sometimes used but with great difficulty due to its instability. On a weight basis it is about four times as strong as sulfate. It is extremely reactive and forms complex salts of lesser catalytic effect with compounds such as silica, silicate, borate, aluminate, titanate, zirconate, ferrates, phosphates, antimonates, stannates, niobates, etc. A further source of the instability of fluoride is the loss of fluoride due to volatility as hydrofluoric acid.

Fink mentions nitrate and organic radicals as examples of unstable radicals but these are generally regarded as impurities in the bath and their presence is usually avoided. The same is true of the chloride which Fink regarded as an undesirable impurity.

Some promising indications of beneficial results from chloride additions to hexavalent chromium plating solutions were reported about 50 years ago but these were not followed up and chloride is generally regarded as an injurious impurity. See, for example, Dubpernell, G. "Electrodeposition of Chromium from Chromic Acid Solutions" 1977, Pergamon Press New York, pages 25–35.

A few years ago, Perakh et al suggested the use of chloride in chromium plating solutions and this work is described in U.S. Pat. No. 4,234,396 issued Nov. 18, 1980. There are, however, substantial drawbacks to the bath and process described by Perakh et al. Examples 1–6 of the Perakh et al patent refer to chromispel-C plating baths where large amounts of chromic acid and chlorides are utilized, ostensibly to increase the current efficiency. However these examples yield dull, poorly adhering deposits and the temperature range is only about 19° C.–45° C. which is generally considered room temperature or only slightly thereabove. In these examples it appears that the chloride is being used as the catalyst in place of the conventional sulfate radical.

Examples 16 through 19 of the Perakh patent describe the use of the plating bath including the sulfate catalyst; example 16 includes chlorine, example 17 iodine, examples 18 and 19 both chlorine and iodine. In each case, however, the deposit was dull even though the current efficiency increased in those examples where large amounts of chlorine were present.

None of the prior art, however, describes a chromium plating process wherein a good distribution of a bright, highly adherent and durable chromium plate may be obtained in the presence of both the sulfate catalyst and chlorine.

SUMMARY OF THE INVENTION

The present invention relates to an improved chromium plating process where both the distribution of the chromium plate and its brightness are substantially increased because of the addition and maintenance of a desired amount of chlorine where the chlorine is present in compounds of several valence states simultaneously and wherein equilibrium is maintained.

If pure chromic acid solutions are electrolyzed, no oxidation or reduction takes place. If a sulfate catalyst is added, the chromic acid which is $CrO_3$ and thus contains chromium VI begins to be reduced at the cathode to small amounts of metallic chromium and chromium III. Any chromium III formed can begin to be reoxidized to chromium VI at the lead anode. According to Fink, the desired amount of sulfate in the solution is one percent of the chromic acid present, by weight, so that a maximum amount of metallic chromium will be deposited at the cathode. With the one percent of sulfate present there is maximum deposition of metallic chromium which means, of necessity, that these conditions are also most favorable for minimal accumulation of the chromium III which is formed and which is constantly reoxidized at the anode to chromium VI. Furthermore, according to Fink, if the amount of sulfate exceeds one percent of the amount of chromic acid, metallic chromium production is decreased but chromium III production continues to increase and the bath is said to be oversulfated. The throwing power or covering power, or plate distribution, are adversely affected and rapidly descrease.

However, according to the principles of the present invention, even if the sulfate level substantially exceeds one percent by weight of the amount of chromic acid, a bright, well distributed chromium plate is obtained. Thus the chromium baths are made operable over a wide range of composition with superior results, instead of being confined to operation at close to a single maximum or optimum compositions.

Although the aforementioned Perakh et al patent does describe the use of chlorine in several of the examples, no mention is made of an equilibrium condition including chlorine compounds at several valence states. Furthermore, Perakh authored an article "Chromispel—Novel Process of Chromium Electroplating with Extremely High Efficiency" reported in the Proceedings of INTERFINISH 80, October 1980, p. 84–86, Kyoto, Japan. In this article, which describes the various Chromispel baths which are also described in the patent, Perakh explains that after 300 A-hour/l about half of the chlorine is lost. It is believed that the loss of chlorine is due to chlorine gas evolution at the anode which, for all practical purposes, precludes any suggestion that in the Perakh process there is either the formation of chlorine compounds of different valence states or any equilibrium thereof.

Thus the present invention is directed to a new and improved chromium plating process to improve the distribution and brightness of a chromium plate by the addition and maintenance of a desired amount of chlorine compounds of different valence states in an equilibrium condition.

BRIEF DESCRIPTION OF THE DRAWINGS

The various features, objects, advantages and benefits of the present invention will become more apparent upon reading the detailed description of the invention taken in conjunction with the drawings.

In the drawings.

DETAILED DESCRIPTION OF THE INVENTION

Figure 2:
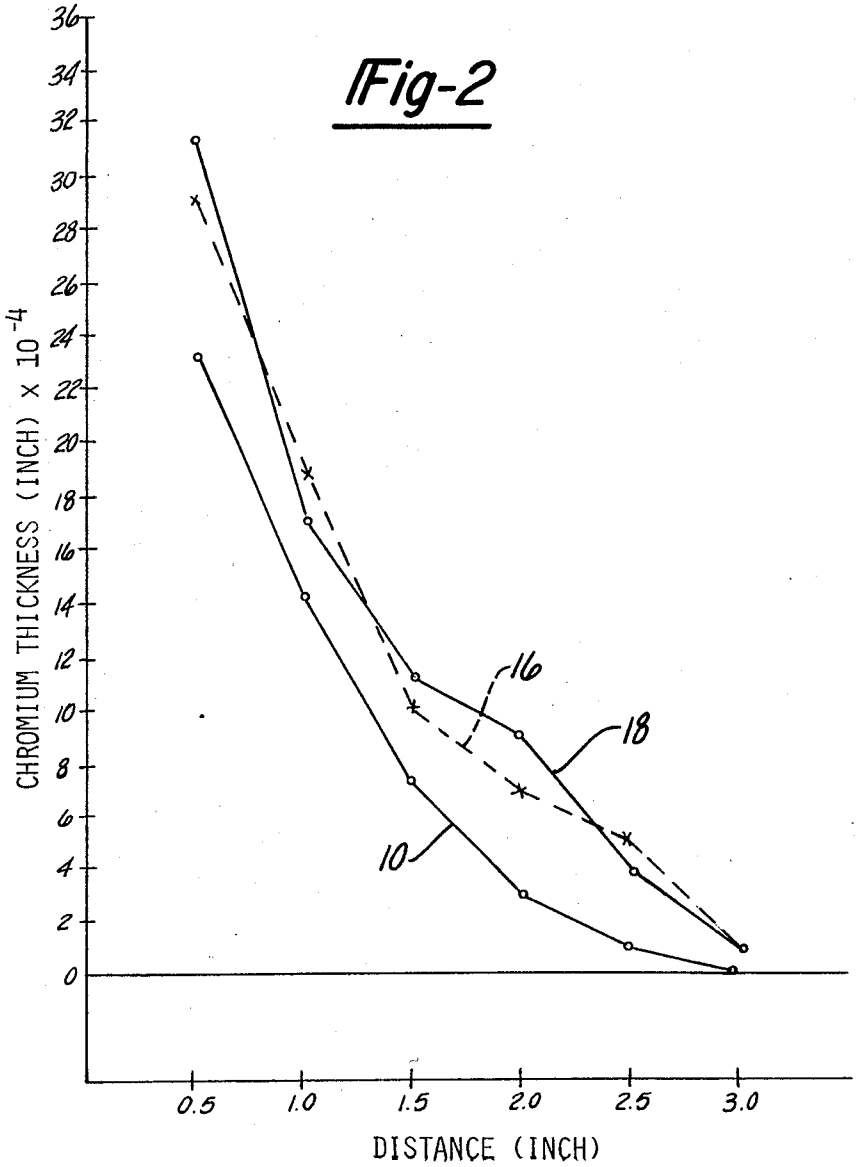
FIG. 2 is a graph showing chromium plate thickness on three steel panels plotted against distance from the high current density end nearest to the anode for a second series of tests.

The present invention relates to the electrodeposition of chromium from a chromium plating bath including a sulfate catalyst and a controlled amount of chlorine maintained in equilibrium and at different valence states in the bath. As used in this application, chlorine does not mean solely chlorine gas but is used in the broad sense such as to refer to $Cl^x$ where "x" includes the range of −1, 0, and 1–7.

According to principles of the present invention, chlorine added to the chromium plating solution in small amounts such as less than 0.1 g/l was not usually beneficial. Good results were only obtained when larger amounts of chlorine catalyst were absorbed into the chromium plating solutions by heating the solution for a short time to establish the polyvalent equilibrium conditions and preferably after the solution had been activated by sulfate or sulfuric acid additions up to at least 1% sulfate as compared to the chromic acid concentration, but preferably of substantially greater amounts such as at least double. Based upon this discovery, the distribution of the chromium plate is substantially improved, i.e., better throwing and covering power, and thicker plates were obtained at low current densities. Furthermore, the brightness of the plate was substantially improved and the current efficiency was increased above the maximum current efficiency previously described by Fink. These were astonishing and totally unexpected results.

It appears that chlorine (especially hydrochloric acid) was oxidized to the higher valence compounds all the way up to chlorate and perchlorate and that the equilibrium mixture of the chlorine compounds which resulted was a great benefit to the chromium plating bath. Electrolysis with the customary lead anodes was also helpful in the oxidation of the chlorine, the same as increased concentration of the chromic acid solution, and there was no loss of chlorine by chlorine gas evolution at the anodes.

The beneficial effects were also obtained with additions of perchlorate or perchloric acid but not as strongly as starting with hydrochloric acid. This appeared to be due to the relatively greater stability of perchlorate; it does not give chromium plate when added to chromic acid alone and gives only chromic oxide deposits combined with chromic acid, i.e., chromium chromate, whereas chlorate gives chromium plate at a good current efficiency without the need for any other catalyst. Thus it seems likely that any beneficial effects of perchlorate additions are due to reduction products produced at the cathode in small amounts during electrolysis. Stated differently, it appears that the desirable equilibrium mixture of oxidation and reduction products of chlorine may be attained more readily by hydrochloric acid additions than by additions of perchloric acid, with each addition being followed by a period of heating and electrolysis.

In the present invention no chlorine gas evolution was noted when lead anodes were used. Small quantities of hydrochloric acid sometimes evolved under the powerful reducing conditions at the cathode where chromium was being deposited and hydrogen gas evolved. The chromium was usually deposited directly upon bright steel cathodes and the steel was corroded by the fumes above the solution level in a manner typical of hydrochloric acid. Longer electrolysis resulted in more extensive corrosion.

In order to stabilize the chlorine and obtain equilibrium conditions in the baths, it is necessary to make frequent additions of chlorine compounds probably at least once a day and more often under heavy production conditions. Concentrations in the range of 0.1 to 1.5 g/l or more chlorine content in a "Fink" type solution of 250 g/l chromic acid and 2.5 g/l sulfate operated satisfactorily.

A method of analysis was developed to determine the total chlorine content of the baths. This method consisted of placing a 1–2 ml sample of the bath on about 4 g or more of sodium carbonate in a nickel or stainless steel crucible. The sample is then covered with another one or two grams of sodium carbonate and heated to fusion at about 800° C., red heat, for about 10 minutes. This is then gradually dissolved in about 20 ml of distilled water and transferred to a 250 ml beaker. The solution is made slightly acid to litmus paper by adding 1:1 nitric acid. Then three drops of 0.10 normal silver nitrate is added as an indicator and the solution is titrated from turbid to clear with 0.01 normal mercuric nitrate solution. The amount of chlorine compounds present can then be calculated and then additions can be made to bring the bath concentration to the desired range.

The need for frequent additions of catalysts lost by evaporation is not new. The loss of hydrofluoric acid from baths containing the fluoride catalyst is well known. A calculation shows that this loss amounts to about 0.00029 g of hydrofluoric acid per A-hour/l at 65° C. in solutions containing silico-fluoride additions to about 3 g/l $SiF_6^{--}$. A similar calculation for hydrochloric acid loss in solutions containing 0.7–0.9 g/l chloride as HCl after electrolysis for 10 hours at 50° C. showed a loss of about 0.00867 g HCl/A-hour/1. This indicates about 30 times greater volatility for hydrochloric acid at 50° C. as for hydrofluoric acid at 65° C. but these figures should be taken as only approximately indicative of expected loss by evaporation.

Reference should now be had to the drawings for an explanation of the test results of the present invention. The three Figures show the results of the thickness of the chromium plate obtained in five hour plating tests on steel cathodes. For FIGS. 1 and 2 a standard 534 ml Lucite acrylic Hull cell was used. For FIG. 3 a round glass cell was used, 7.5" diameter and 3.75" deep, and containing 1.5 l of solution.

Figure 1:
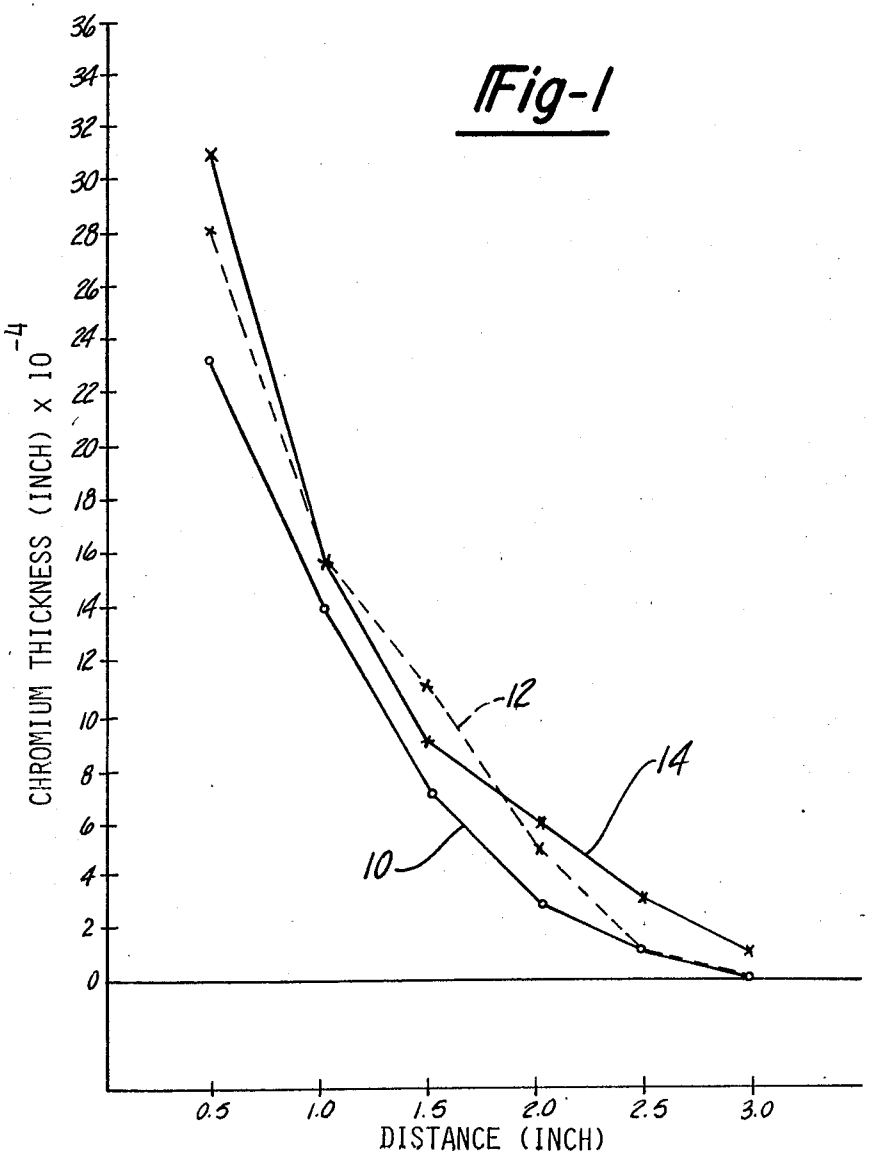
FIG. 1 is a graph showing chromium plate thickness on three steel panels plotted against distance from the high current density end nearest to the anode for a first series of tests.

For FIG. 1, two baths were prepared, each containing 250 g/l chromic acid and 2.5 g/l sulfate. The first bath (Example 1) was not modified. The second bath (Examples 2 and 3) received an addition of 0.10 g/l chlorine as hydrochloric acid. Both baths were operated at 50° C. drawing a current of 5 amperes for 5 hours. Curve 10 reflects the plot of chromium thickness as a function of distance from the high current density end of the cathode nearest to the anode, in the absence of the chloride addition (Example 1) and curves 12 and 14 represent the plots of chromium thickness as a function of distance from the high current density end of the cathode nearest to the anode, in two successive five-hour electrolyses of the bath which included 0.10 g/l chloride (Examples 2 and 3). The substantial increase in plating thickness may be observed from the graph and, in addition, the plating was bright (which should be contrasted with the dull plating results reported by Perakh et al).

Two additional electrolyses were conducted (Examples 4 and 5) in a solution containing 250 g/l chromic acid, 2.5 g/l sulfate and 1.4 g/l chlorine as hydrochloric acid. The bath was operated at 50° C. drawing 5 amperes current for 5 hours and the thickness of the plate as a function of distance from the high current density end of the cathode nearest to the anode, is illustrated by curves 16 and 18 in FIG. 2. It should be noted that curve 10 is re-plotted in FIG. 2 for convenience. The substantial increase in thickness of the chromium plate for Examples 4 and 5 may be noted as compared to Example 1. Again the plate was bright in the presence of the chlorine compounds.

Examples 6, 7 and 8

Three additional baths were prepared each having 250 g/l of chromic acid and 3.5 g/l of sulfate which is above the maximum amount of sulfate suggested by Fink. According to Fink, the use of 3.5 g/l of sulfate in the presence of only 250 g/l of chromic acid would provide a reduction in the thickness of the plate. The second of these three baths contained 0.75 g/l chlorine and the third bath contained 1.50 g/l chlorine. In each example the chlorine was in the form of hydrochloric acid. All three baths were operated at 55° C. with the current density of 1 A/in.$^2$ for 5 hours and it should be noted that the cathode was shortened to 2.5". In addition, the cathode was plated on both sides with 10 amperes total current and with the low current density end pressed against the glass wall of the container furthest away from the anode and at a right angle to it.

Figure 3:
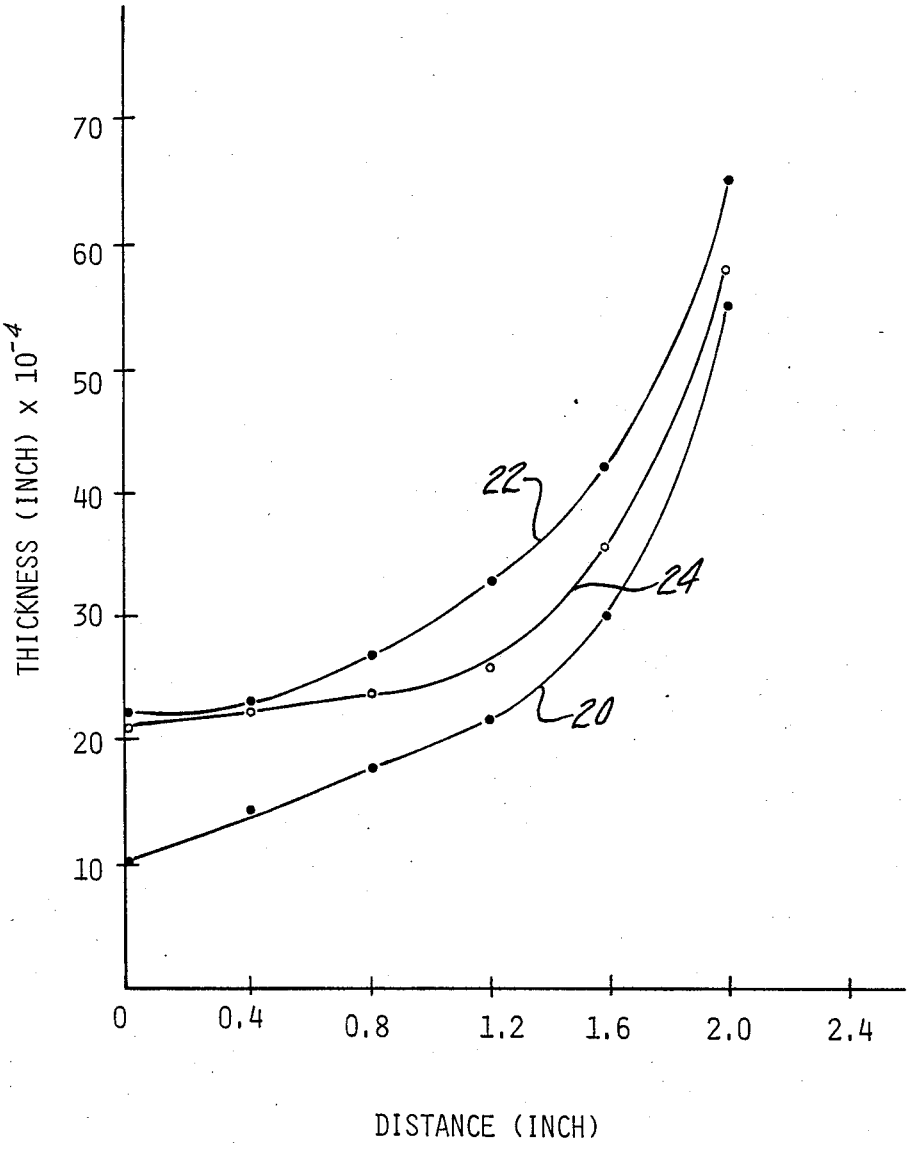
FIG. 3 is a graph showing chromium plate thickness on three steel panels plotted against distance from the low current density end furthest from the anode in several additional tests.

These three baths are plotted in FIG. 3 as curves 20, 22 and 24 respectively. A substantial improvement was noted from all of the chlorine additions even though the solution was already "over catalyzed" with sulfate when compared to the standards as set forth in the Fink patent. Substantial improvement in the thickness of the plate in the presence of the chlorine compounds is noted when comparing curves 22 and 24 to curve 20. Again the deposits were extremely bright.

Results such as these have never been reported previously and are contrary to the principles of the Fink patent that once the maximum effect of a sulfate catalyst has been obtained at a 100/1 ratio, further additions of any catalyst can only be injurious to the current efficiency and plate distribution. This is a remarkable discovery that substantial quantities of chlorine, particularly in the form of hydrocloric acid, will react with a solution and form equilibrium concentrations of various higher valence oxidation products such as chlorine, hypochlorite, chlorite, chlorate and perchlorate which in combination improve the brightness, current efficiency and distribution of the plate.

Furthermore, by comparison of these results to the results reported by Perakh et al, it appears that in Perakh et al chloride acts solely as a catalyst for the chromium deposition whereas in the present invention the sulfate acts as the catalyst and the chlorine acts in an unusual and enexpected manner to improve the brightness, current efficiency and distribution of the plate even in what was previously considered to be an "over catalyzed" chromium plating bath.

Separate tests were made not only with hydrochloric acid and sodium chloride but also with four other higher valence oxidation products added to pure chromic acid. With the exception of perchloric acid and perchlorate, each of the high valence oxidation products permitted the production of quality chromium deposits. The perchlorates give only reddish-brown oxide deposits when added alone to the pure chromic acid solutions. When sodium perchlorate was added to the Fink-type bath, improvements in plate distribution and covering power were generally noted particularly in baths already deemed "over sulfated" or "over catalyzed". Especially striking, reproducible results were obtained when sodium perchlorate was added to a Fink-type solution of double the common concentration, i.e., 500 g/l of $CrO_3$ and double the optimum sulfate concentration, i.e., 10 g/l $SO_4^{--}$, a ratio of 50:1 instead of 100:1. In this case, the improvement in plate distribution and coverage was uniform throughout the range.

Another series of tests with each of the higher valence chlorine derivatives added to the Fink-type solution of optimum concentration ratios of 100:1 chromic acid to sulfate at a temperature of 50° C., showed improvement of varying degrees but in each case definite improvement. Thus, each additive improved the brightness and also the current efficiency when a small amount of additive was used. The materials tested were HCl, NaCl, $Ca(ClO)_2$, $NaClO_2$, $NaClO_3$, $NaClO_4$, and $CrO_2Cl_2$. Even the $NaClO_4$ had a slight effect similar to the other materials. It is felt that this is probably due to some reduction to HCl at the cathode during the 15 minute current efficiency tests.

Chromyl chloride (chromium dioxydichloride) $CrO_2$-$Cl_2$ had somewhat stronger effects than the other chemicals but only moderately stronger. However, it may be a key chemical in the equilibrium existing in the chromium plating bath during operation of the present invention. In it, the chromium is commonly regarded as still hexavalent and it is readily formed to some extent whenever strong hydrochloric acid and chromic acid are mixed. It is a dark red liquid similar to bromine and quite soluble in chromium plating solutions. It may possibly be considered a more easily reduced form of chromic acid.

According to the principles of the present invention, chromium plating should not be attempted immediately following any large additions of the chlorine compound or else dull deposits may be obtained at low current densities. A short time should be allowed for the chlorine compound to be absorbed into the warm chromic acid solution and to establish the beneficial equilibrium of the different valence reaction products. Some tests with solutions equilibrated by preheating to 80° C. for one hour after the addition of NaCl or HCl to the 250 g/l chromic acid solution containing no sulfate showed distinctive improvement after the equilibrating treatment and the HCl addition particularly gave about double the current efficiency when so treated.

A convenient procedure is to make additions to the solutions at the end of the day and then maintain the solution at operating temperature all night. If, however, continuous production is desired, more frequent and smaller additions may be made on a regular schedule since small additions are absorbed into the solution equilibrium almost instantly if the solution contains a normal amount of sulfate to activate the oxidation of the chlorine additive particularly if the chlorine additive is hydrochloric acid. The presence of fluoride compounds is also helpful. Good results were obtained with Hull cell plating tests with graduated additions of sodium perchlorate to a solution containing 250 g/l chromic acid, 1.5 g/l sulfate and 4.0 g/l silico fluoride as sodium silicofluoride.

Another method of making additions would be to prepare an addition agent containing chromic acid and the desired equilibrium mixture of oxidation products. Thus a solution of 250 g/l chromic acid could be mixed with 50% by volume hydrochloric acid in the desired quantity and then the mixture heated gently for a short time or allowed to stand in order to reach equilibrium. Thus the present invention contemplates that after a determination is made as to how much chlorine compound should be added, a separate solution containing some chromic acid and the desired amount of chlorine for the entire bath may be separately heated to reach an equilibrium condition and then added to the plating bath.

It is becoming customary to recover the mists or fumes from chromium plating baths, particularly from the cathode compartment, by passing the exhaust gas through a fume scrubber, which itself may utilize rinse or wash water containing a low concentration of the chromium solution. The recovered solution is concentrated somewhat by evaporation and purified by passing through a cation exchange treatment. The resultant solution is used for make up additions to the chromium bath. Such a procedure will recover most or all of the chlorine compounds lost at the cathode, reduce maintenance additions to very small quantities, and stabilize this type of operation. The fumes should not be collected from both the anode and cathode together, as this can result in an explosive mixture of hydrogen and oxygen.

The foregoing is a complete description of the present invention. Various changes and modifications may be made without departing from the spirit and scope of the present invention. The invention, therefore, should be limited only by the following claims.

What is claimed is:

1. A process to improve the distribution and brightness of chromium plate from a Cr VI bath, said bath including chromium trioxide and at least 0.4 weight percent sulfate as a catalyst, said weight percent based upon the weight of the chromium trioxide, said bath being operated generally in the range of 40°–60° C., the improvement comprising adding chlorine compounds and maintaining equilibrium between oxidized and reduced chlorine compounds in said bath, the amount of chlorine compounds in the bath being generally maintained in the range of between about 0.04–0.60 weight percent chlorine based upon the chromium trioxide said oxidized and reduced chlorine compounds having been formed by heating the chlorine compounds in an oxidizing medium to at least about 80° C. for at least about one hour.

2. The invention as defined in claim 1 wherein said catalyst is essentially sulfate.

3. A process to improve the distribution and brightness of chromium plate from a Cr VI bath, said bath including chromium trioxide and catalyst containing fluoride and at least 0.1 weight percent sulfate based upon the weight of the chromium trioxide, said bath being operated generally in the range of 40°–60° C., the improvement comprising adding chlorine compounds and maintaining equilibrium between oxidized and reduced chlorine compounds in said bath, the amount of chlorine compounds in the bath generally maintained in the range of between about 0.04–0.60 weight percent chlorine based upon the chromium trioxide said oxidized and reduced chlorine compounds having been formed by heating the chlorine compounds in an oxidizing medium to at least about 80° C. for at least about one hour.

* * * * *